US010221604B2

(12) United States Patent
Zimmer et al.

(10) Patent No.: US 10,221,604 B2
(45) Date of Patent: Mar. 5, 2019

(54) ACCELERATION AND DECELERATION ARRANGEMENT

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 116 days.

(21) Appl. No.: 15/072,288

(22) Filed: Mar. 16, 2016

(65) Prior Publication Data

US 2016/0273256 A1 Sep. 22, 2016

(30) Foreign Application Priority Data

Mar. 17, 2015 (DE) ..... 10 2015 003 415

(51) Int. Cl.

*E05F 1/16* (2006.01)
*E05F 5/00* (2017.01)
*E05F 5/02* (2006.01)

(52) U.S. Cl.

CPC ..... *E05F 1/16* (2013.01); *E05F 5/003* (2013.01); *E05F 5/027* (2013.01); *E05Y 2201/21* (2013.01); *E05Y 2201/264* (2013.01); *E05Y 2800/24* (2013.01); *E05Y 2900/132* (2013.01)

(58) Field of Classification Search

CPC ..... E05F 3/02; E05F 1/16; E05F 5/003; E05F 15/0669

See application file for complete search history.

(56) References Cited

U.S. PATENT DOCUMENTS 5,207,781 A * 5/1993 Rock ..... A47B 88/467 312/319.1
6,848,759 B2 * 2/2005 Doornbos ..... E05F 1/16 16/64
7,028,370 B2 * 4/2006 Hoshide ..... E05F 1/16 16/90
7,743,464 B2 * 6/2010 Tomioka ..... E05F 3/102 16/49
8,186,489 B2 * 5/2012 Zimmer ..... E05F 1/16 188/265
8,240,788 B2 * 8/2012 Juan ..... A47B 88/483 312/333
8,307,497 B2 * 11/2012 Chang ..... E05F 5/003 16/49

(Continued)

FOREIGN PATENT DOCUMENTS

CN 1026 19435 A 8/2012
CN 202509933 * 10/2012

(Continued)

*Primary Examiner* — Jeffrey O'Brien
(74) *Attorney, Agent, or Firm* — Klaus J. Bach

(57) ABSTRACT

In acceleration and deceleration arrangement comprising a carrier element connected to an energy storage spring and supported on a guide surface so as to be movable between a park position and an end position wherein a piston of a motion damping cylinder piston unit is moved by the carrier element in a deceleration stroke direction when the carrier element is moved by a tension spring from the park position to the end position, the carrier element has a spring deflection area which is abutted by the tension spring so as to apply a tilting torque to the carrier element for pivoting the carrier element into a holding section provided in the guide surface at the park position of the carrier element.

9 Claims, 6 Drawing Sheets

(56) References Cited

U.S. PATENT DOCUMENTS 8,671,520 B2 * 3/2014 Tanno ..... E05F 1/16 16/49
8,714,671 B2 * 5/2014 Huang ..... A47B 88/467 312/319.2
8,745,821 B2 * 6/2014 Chang ..... E05F 5/003 16/49
8,746,422 B2 * 6/2014 Zimmer ..... E05F 1/16 188/265
8,888,200 B2 * 11/2014 Sato ..... E05F 5/003 312/319.1
9,435,152 B2 * 9/2016 Zimmer ..... E05F 1/16
2001/0008037 A1 * 7/2001 Brustle ..... E05F 1/16 16/71
2003/0234604 A1 * 12/2003 Lin ..... A47B 88/467 312/334.6
2009/0121596 A1 * 5/2009 Ferrari ..... E05F 5/003 312/334.8
2011/0138579 A1 * 6/2011 Sato ..... E05F 1/16 16/93 R
2013/0014343 A1 * 1/2013 Tanno ..... E05F 1/16 16/49
2014/0026358 A1 * 1/2014 Saito ..... E05F 5/003 16/72
2016/0076288 A1 * 3/2016 Bantle ..... E05F 1/16 49/417
2016/0273253 A1 * 9/2016 Zimmer ..... E05D 15/0669
2016/0273254 A1 * 9/2016 Zimmer ..... E06B 3/4636
2016/0273256 A1 * 9/2016 Zimmer ..... E05F 5/027
2016/0333622 A1 * 11/2016 Glogowski ..... E05F 5/003
2016/0340954 A1 * 11/2016 Zimmer ..... E05F 5/003
2016/0340955 A1 * 11/2016 Zimmer ..... E05F 5/003

FOREIGN PATENT DOCUMENTS

DE 20 1009 005 433 U1 8/2009
DE 20 2012 007 763 U1 10/2012
EP 2 728 094 A1 1/2013

* cited by examiner

ACCELERATION AND DECELERATION ARRANGEMENT

BACKGROUND OF THE INVENTION

The present invention resides in an acceleration and deceleration arrangement with a carrier element which is movable by the release of spring energy from a force- and/or form-locked secure park position into an end position wherein a piston of a piston cylinder unit is moved by the carrier element in a retardation stroke direction for braking the carrier element. The invention also resides in a door fitting including such an acceleration and deceleration arrangement and in a sliding door provided with such a door fitting.

An acceleration and deceleration arrangement of this type is disclosed in CN 202596402 U. With this arrangement however, noises may be generated upon locking of carrier element in, or releasing it from, the park position.

It is the object of the present invention to provide a low-noise acceleration and deceleration arrangement as well as a door fitting with such a low-noise acceleration and deceleration arrangement and a sliding door with such a door fitting.

SUMMARY OF THE INVENTION

In an acceleration and deceleration arrangement comprising a carrier element connected to an energy storage spring and supported on a guide surface so as to be movable between a park position and an end position wherein a piston of a motion damping cylinder piston unit is moved by the carrier element in a deceleration stroke direction when the carrier element is moved by a tension spring from the park position to the end position, the carrier element has a spring deflection area which is abutted by the tension spring so as to apply a pivot torque to the carrier element for pivoting the carrier element into a holding section provided in the guide surface at the park position of the carrier element.

The invention will become more readily apparent from the following description of an exemplary embodiment thereof with reference to the accompanying drawings.

BRIEF DESCRIPTION OF THE DRAWINGS

It is shown in.

DESCRIPTION OF AN EXEMPLARY EMBODIMENT

Figure 1:
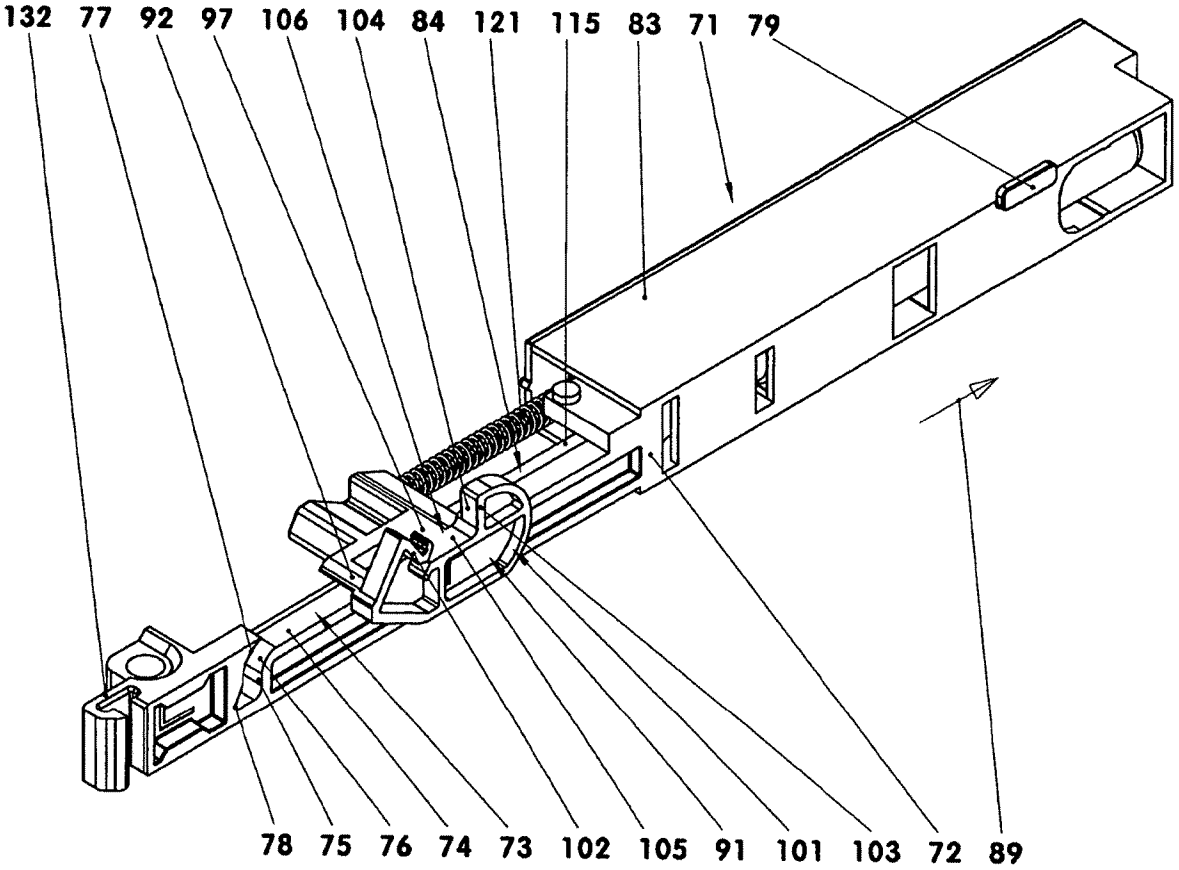
FIG. 1: an acceleration and deceleration arrangement.

FIG. 1 shows a combined acceleration and deceleration arrangement 71 in an isometric view. Such acceleration and deceleration arrangements 71 are used to brake down movable objects, for example drawers, sliding doors, etc., when they approach an open or closed end position and to guide them to the end position shock-free.

Figure 2:
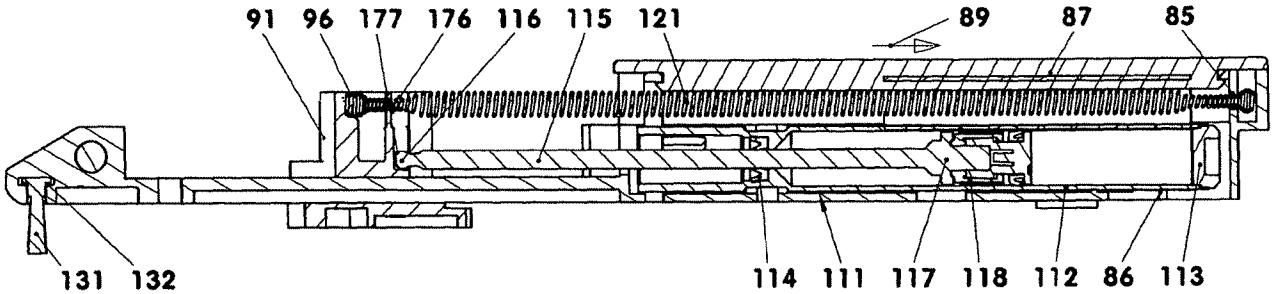
FIG. 2: a cross-sectional view of the acceleration and deceleration arrangement.
Figure 3:
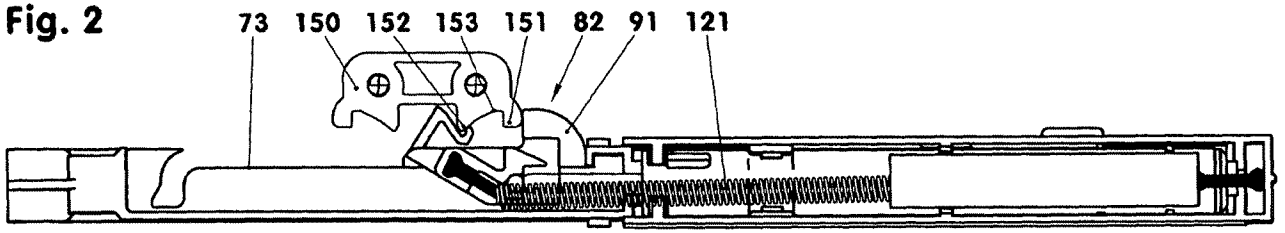
FIG. 3: the acceleration and deceleration arrangement in the end position.
Figure 4:
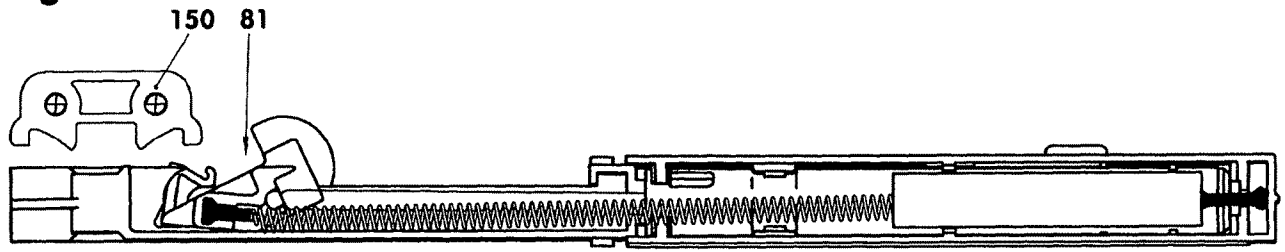
FIG. 4: the acceleration and deceleration arrangement in the park position.

The acceleration and deceleration arrangement 71 comprises a support part 72 in which a carrier element 91 is supported so as to be movable between a force and/or form locking secure park position 31 and an end position 82, see FIGS. 2-4. Between the carrier element 91 and the support part 72, an energy store 121 in the form of a tension spring 121 is arranged which pulls the carrier element 91 toward the end position 82. Further, a piston rod 115 of a cylinder piston unit 111 connected to the support part 72 is connected to the carrier element 91.

Figure 5:
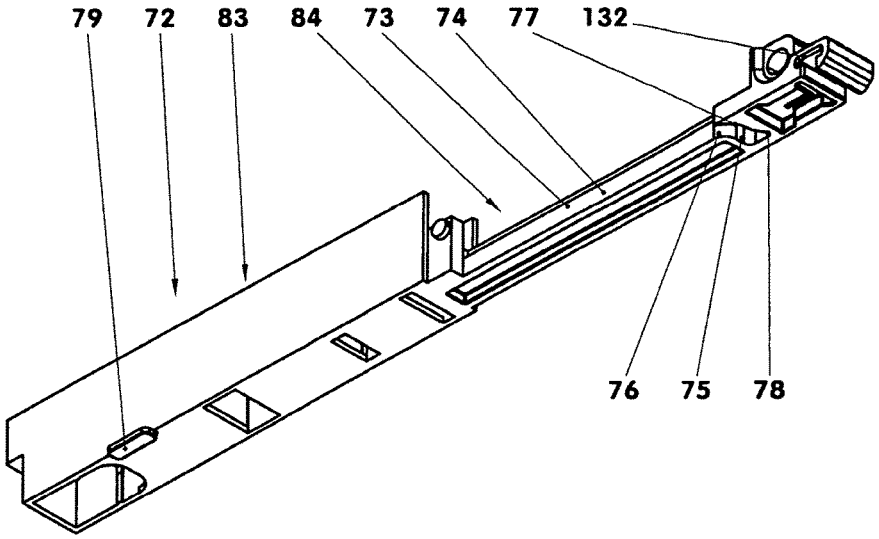
FIG. 5: a component support part.

The support part 72 alone is shown in FIG. 5. It has a receiver area 83 and a guide area 84. In the receiver area 83, a spring holder 85 and a cylinder holder 86 are arranged. The receiver area 83 is shown closed by a cover 87 in the exemplary embodiment. It further includes a stop 79 which projects sidewardly from the receiver area 83.

The guide area 84 comprises a guide surface 73 and a brush holder 132. However, the guide area 84 may also be without brush holder 132.

The guide surface 73 has a straight guide section 74 and a holding section 75. These two sections 74, 75 are joined by a convexly curved section 76. The guide surface 73 has a constant width over the full length thereof. The guide section 74 extends parallel to the longitudinal direction 15 of the cylinder piston unit 111. The holding section 75 extends for example normal to the guide section. The holding section 75 and the curved section 76 are part of a guide groove 77 which has a widened end area 78.

Figure 6:
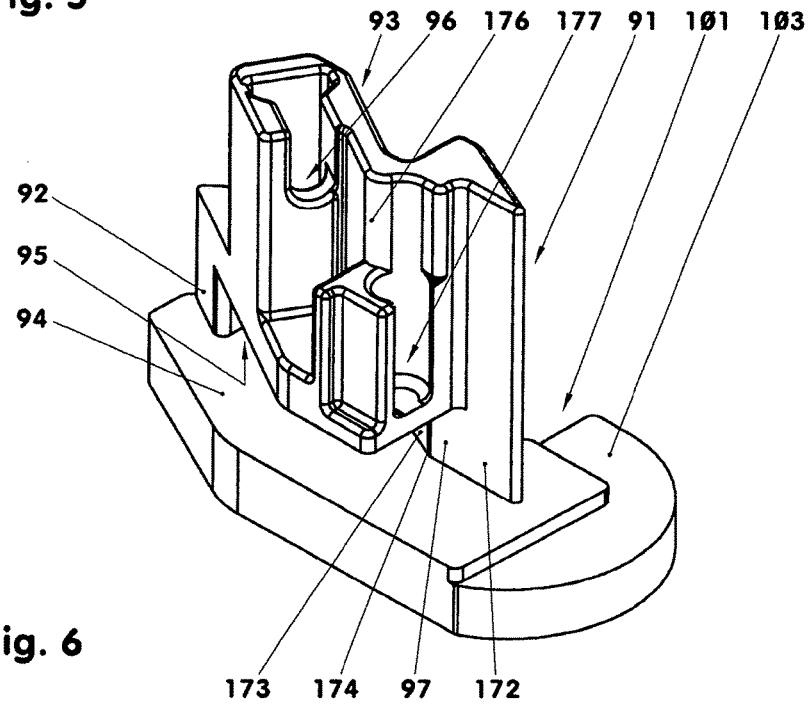
FIG. 6: a carrier element.

The carrier element 91 extends over the support part 72 and is movable along the guide section 74. In FIG. 6, the carrier element 91 is shown in an isometric view. It comprises first and second slide elements 92, 97, a guide and accommodation area 93 and a drag range 101.

The slide elements 92, 97 are spaced from each other and abut the guide surface 73. The first slide element 92 is oriented in a direction opposite the deceleration stroke direction 89. The second slide element 97 is oriented toward the piston rod 115. The first slide element 92 and the second slide element 37 interconnect the drag range 101, and the guide and accommodation area 93.

The first slide element 92 has a cross-sectional area in the form of a rectangle with rounded corners. The downwardly facing curved contact surface 98 shown in FIG. 7 abuts the guide section 74. The contact line forms a momentary pole line 99.

Figure 7:
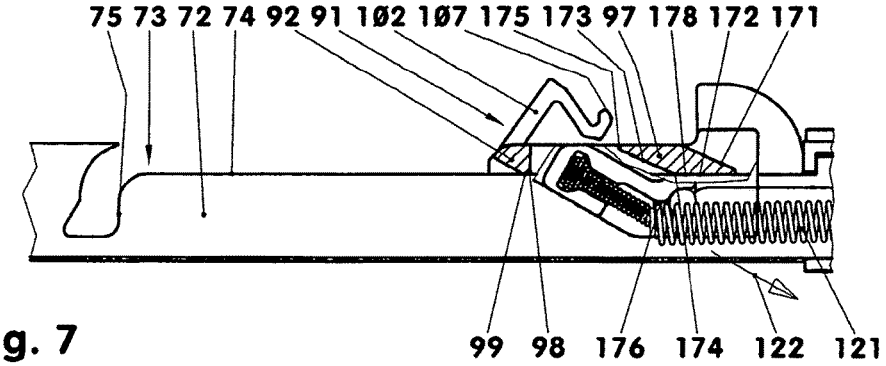
FIG. 7: the carrier element in the end position.
Figure 8:
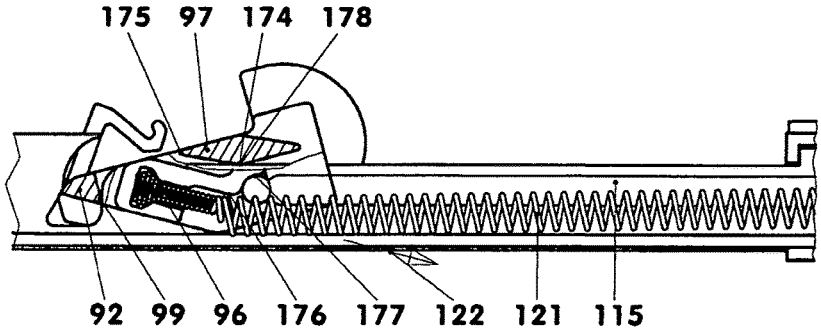
FIG. 8: the carrier element in an intermediate position.
Figure 9:
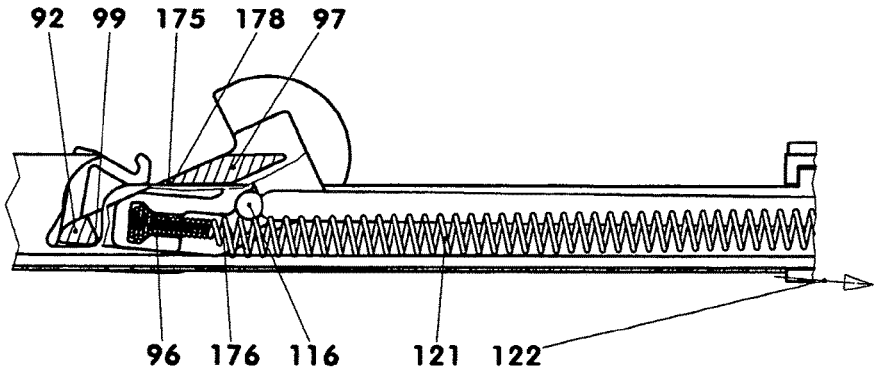
FIG. 9: the carrier element with park position.

The second slide element 97, see FIGS. 7-9, has an at least substantially trapezoid-like cross-sectional surface area with rounded corners. The side surface areas 171, 172 of the trapezoid have the same length wherein the smaller enclosed angle is for example 25 degrees. At this angle the radius of the concavely curved second connecting area 175 is for example half the radius at the first connecting area 174 between the side surface areas 172, 173 which extend at an obtuse angle. The side surface areas 171-173 of the second slide element 97 may also have different lengths. For example, the second slide element 97 may have the form of a parallepipedon, a prism or a wedge etc. The first slide element 92 and the second slide element 97 have the same height. Their distance is for example three times their height.

The drag range 101 comprises two stops 102, 103, which are provided with stop surfaces 104, 107, which face each other and which are oriented for example normal to the tangential plane of the slide elements 92, 97. The two stop surfaces 104 define together with a bottom area 105 a carrier cavity 106. The drag range 101 has a first guide surface area 94 which faces the support part 72. The stop 102 facing the holding section 75 is elastically deformable in the exemplary embodiment. The stop 103 facing away from the piston rod 115 may also be elastically deformable.

The guide and accommodation area 93 comprises a second guide surface area 95 which extends parallel to the first guide surface area 94 as well as a spring holder 96. The spring holder 96 extends at an angle of 30° with respect to the bottom area 105 of the carrier element 91 and in a direction away from the holding section 75.

In the spring holder 96, one end of a tension spring is engaged. The tension spring 121 may abut a spring deflection area 176 which is formed on the carrier element 91. The other end of the tension spring 121 is supported in the support part 72.

The cylinder-piston unit 111 comprises a cylinder 112 and a piston 117 guided in the cylinder 112 via a piston rod 115. At its front end remote from the piston 117, the piston rod 115 has a piston rod head 116 which is pivotally supported in the carrier element 91. The piston rod support 177 is arranged next to the spring deflection area 176.

The cylinder 112 has a closed cylinder end 113. Its interior wall may be cylindrical or conical. The inner cylinder wall has for example two axial grooves of different lengths which both extend from the cylinder end 113. The length of the shorter groove is for example one fourth of the length of the cylinder 112. The length of the longer groove is for example three quarters of the length of the cylinder 112. At the piston rod side end, the cylinder 112 is closed by a cylinder head cover 114 including a piston rod seal.

In the exemplary embodiment, the piston 117 includes a piston seal 118 with a sealing lip oriented toward the cylinder end 113. The piston 117 may be formed integrally with the piston rod 115 and/or the piston seal 118.

The acceleration and deceleration arrangement 71 is further provided with a brush holder 132 including a cleaning brush 131.

For example on a sliding door track 140, a carrier member 150 is supported. In the exemplary embodiment, the carrier member 150 is in the form of a component which is symmetrical with respect to a transverse axis and which has four carrier projections 151, 152. In each case, two adjacent carrier projections 151, 152, which are separated by a recess 153 have together a length which is slightly less than the distance of the stop surfaces 104 of the carrier element 91.

During assembly of the acceleration and deceleration arrangement 71 for example, the piston rod 115 with the piston 117 is inserted into the cylinder 112 and the cylinder 112 is closed by a cylinder head cover 114. Then the cylinder-piston unit 111 with the carrier element 91 is mounted to the support part 72 and secured therein and the tension spring 121 is attached to the carrier element 91 and the support part 72. The tension spring 121 may abut for example the spring deflection area 176 of the carrier element 91. Further, the brush holder 132 with the cleaning brush 131 is mounted to the support part 72.

Figure 10:
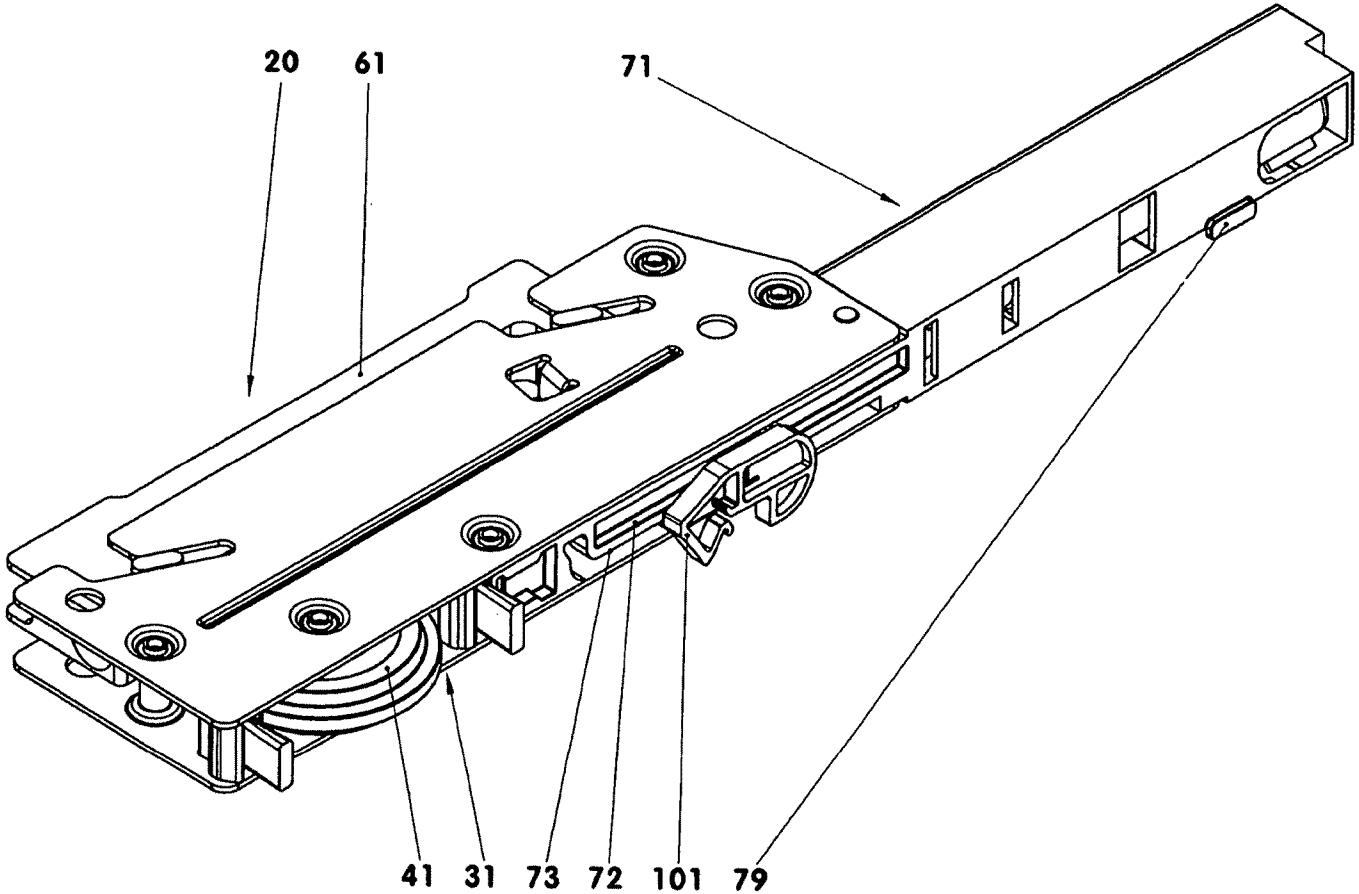
FIG. 10: a door fitting with an acceleration and deceleration arrangement including a braking device.
Figure 11:
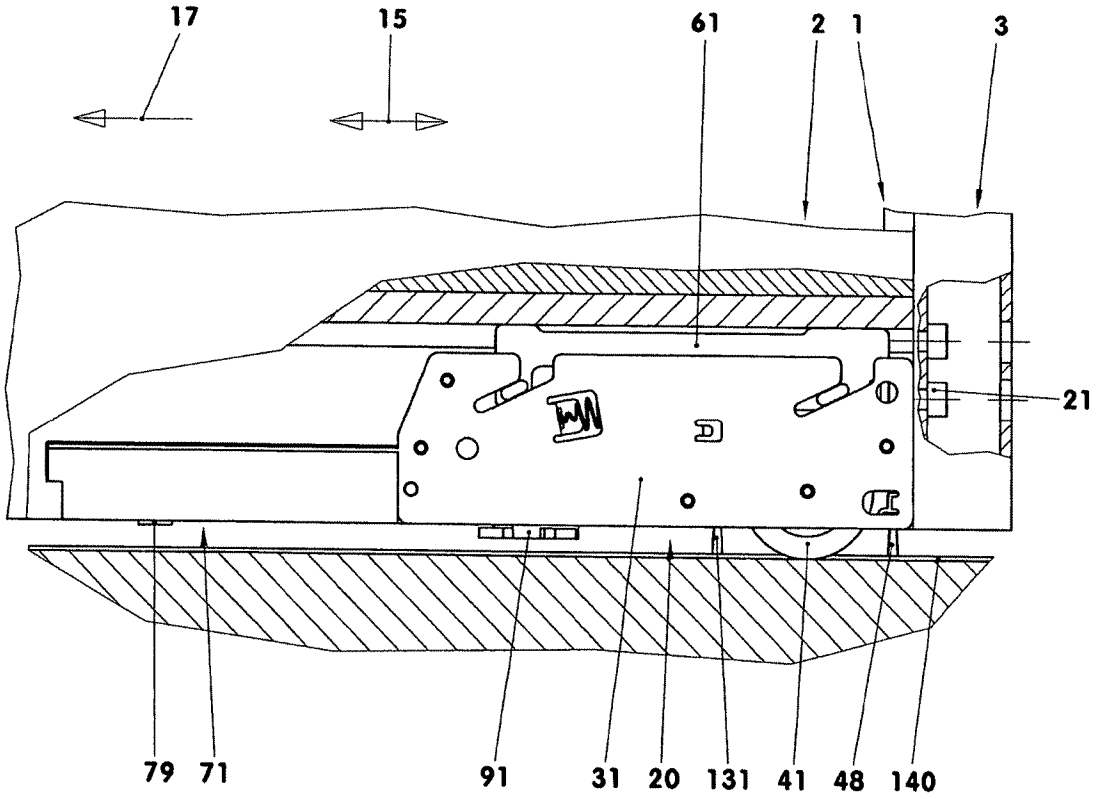
FIG. 11: a sliding door with a door fitting.

In FIG. 10, the acceleration and deceleration arrangement 71 is shown as part of a height adjustable door fitting 20. The door fitting 20 comprises a housing 31 in which a support roller 41, the acceleration and deceleration arrangement 71, a lift member 61 as well as another cleaning brush 48 are arranged. This door fitting 20 is for example mounted, to sliding doors 1, see FIG. 11. By way of an adjustment arrangement, for example an adjustment screw 21 supported by a door frame 3 of the sliding door 1, the height of the sliding door 1 relative to the door track 140 is adjustable.

After installation of the sliding door 1 into the door frame the carrier member 150 is adjusted for example with the aid of a template and fixed by means of mounting screws. When now the door is for example opened, the piston 117 of the acceleration and deceleration arrangement 71 is moved into the cylinder. The carrier element 91 is for example in its end position 81 on the straight guide section 74. The energy store 121 is for example discharged.

When the sliding door 1 is closed for the first time, the carrier member 150 contacts the front stop 102 of the carrier element 91 and, in the process, deforms it. The carrier member projections 151, 152 enter the carrier element cavity 106. The stop 102 deformation is eliminated. The sliding door 1 is now ready for normal operation. The first slide element 92 is disposed with its contact surface 98 on the guide section 74 and the second slide element 97 is disposed with its side surface 171 on the guide section 74. The tension spring 121 abutting the spring deflection area 176 applies to the carrier element 91 a torque in a counter clockwise sense as shown in FIGS. 3 and 7.

Upon a manual or motor-operated opening of the sliding door 1 from the closed position, the carrier member 150 pulls along the carrier element 91 along the guide surface 73 out of the end position toward a park position 81. The energy store 121 is charged in the process.

As soon as the first slide element 92 reaches the guide groove 77, the carrier element 91 pivots into the guide groove 77 under the pull of the spring 121. At the first slide element 92, the momentary pole line 99 moves along the contact surface 98. The second slide element 97 now abuts with the first connecting area 174, the guide surface 73. The contact line between the second slide element 97 and the support part 72 forms the momentary pole line 178 of the second slide element 97. Upon further movement of the sliding door 1 relative to the carrier member 150, the momentary pole line 178 moves a long the outer surface areas of the second slide element 97. The tension spring 121 continues to act on the carrier element 91 with tension as well as torque forces.

Upon further opening of the slide door 1, the carrier element 91 is further pivoted into the guide groove 77. The increasingly tensioned tension spring 121 which abuts the spring deflection area 176 generates further a torsional moment on the carrier element 91. The momentary pole line 99 of the first slide element 92 moves back along the contact line 98 so that, with respect to the carrier element 91, it is located at least essentially in the original position. The momentary pole line of the second slide element 97 moves further along the outer surface of the second slide element 97 for example up to the second connecting area 175. The carrier element 91 is now in a force and/or form-locking park position 81, see FIGS. 4 and 9. In the park position 81, the pulling force of the tension spring 121 acts on the carrier element 91 for example at an angle of 5 degrees with respect to a plane extending parallel to the guide section 74.

In the exemplary embodiment, the direction of the pulling force extends in the parking position 81 with respect to a plane defined by the momentary pole lines 99, 178 at an angle of 42 degrees. The angle is generally greater than 35 degrees.

The sliding door 1 can now be further opened. The carrier element disengages from the carrier member 150. The carrier element 91 remains in the park position 81, see FIGS. 4 and 9.

When the sliding door 1 is being closed, the carrier element 91 contacts the carrier member 150 before the sliding door 1 reaches its end position. The carrier member 150 releases the carrier element 91 from the park position. Hereby, the momentary pole lines 99, 178 move in the opposite direction, see FIG. 8. The energy store 121 is being discharged slowly and shock-free and pulls the carrier element 91 toward the end position. No noises are audible. The sliding door 1 is pulled thereby into its closed position. At the same time, the carrier element 91, which is being moved relative to the cylinder 112, moves the piston 117 into the cylinder 112. The seal lip of the piston seal 118 is suddenly biased into contact with the inner cylinder wall and seals a cylinder internal space against a compensation chamber. The sliding door 1 is braked down. As soon as—with further closing of the sliding door 1—the piston reaches the first longitudinal groove of the inner cylinder wall, gas escapes from the displacement space to the compensation chamber. The movement of the sliding door is determined by the closing force provided by the energy store 121 and also by the retardation force provided concurrently by the cylinder-piston unit 111. As soon as the piston reaches the short longitudinal groove, the retardation force is further reduced. The sliding door 1 now moves slowly into its closed end position. There, it comes to a shock-free standstill. The carrier element 91 is now in its end position 82, see FIGS. 3 and 7.

The sliding door 1 may be provided with another fitting 20, which is arranged at the end of the sliding door 1 pointing into the opening direction 17. By height adjustment of both fittings 20 via an adjustment screw 21, the door panel 2 position can be accurately adjusted. With such an arrangement, the acceleration and deceleration arrangement 71 of the second fitting can be used for a controlled movement of the sliding door into an open end position (1).

A combination of the various exemplary embodiments is possible.

LIST OF REFERENCE NUMERALS

| | |
|---|---|
| 1 | Sliding door |
| 2 | Door panel |
| 3 | Door frame |
| 15 | Longitudinal direction |
| 17 | Opening direction |
| 20 | Door fitting |
| 21 | Adjustment screw |
| 31 | Housing |
| 41 | Support roller |
| 48 | Cleaning brushes |
| 61 | Lifting member |
| 71 | Acceleration and deceleration arrangement |
| 72 | Support part |
| 73 | Guide surface |
| 74 | Guide section |
| 75 | Holding section |
| 76 | Curved section |
| 77 | Guide groove |
| 78 | Widened end area |
| 79 | Stop |
| 81 | Park position |
| 82 | End position |
| 83 | Receiver area |
| 84 | Guide area |
| 85 | Spring holder |
| 86 | Cylinder holder |
| 87 | Cover |
| 89 | Deceleration stroke direction |
| 91 | Carrier element |
| 92 | First slide element |

-continued

| | |
|---|---|
| 93 | Guide and accommodation area |
| 94 | First guide and accommodation area |
| 95 | Second guide surface area |
| 96 | Spring holder |
| 97 | Second slide element |
| 98 | Contac surface |
| 99 | Momentary pole line |
| 101 | Drag range |
| 102 | Stop |
| 103 | Stop |
| 104 | Stop surface |
| 105 | Bottom area |
| 106 | Carrier cavity |
| 107 | Stop surface |
| 111 | Cylinder piston unit |
| 112 | Cylinder |
| 113 | Cylinder end |
| 114 | Cylinder head cover |
| 115 | Piston rod |
| 116 | Piston rod head |
| 117 | Piston |
| 118 | Piston seal |
| 121 | Energy star, tension spring, spring energy storage |
| 122 | Effective force direction |
| 131 | Cleaning brush |
| 132 | Brush holder |
| 140 | Door track |
| 150 | Carrier member |
| 151 | Carrier projection |
| 152 | Carrier projection |
| 153 | Recess |
| 171 | Side surface area |
| 172 | Side surface area |
| 173 | Side surface area |
| 174 | Connecting area |
| 175 | Connecting area |
| 176 | Spring deflection area |
| 177 | Piston rod support |
| 178 | Momentary pole line |

What is claimed is:

1. An acceleration and deceleration arrangement (71) comprising a pivotable carrier element (91) which is connected to a spring (121) forming an energy store (121) so as to be movable by a discharge of the spring energy store (121) from a locking secured parking position (81) to an end position (82), and a cylinder-piston unit (111) with a piston (117) which is movable by the carrier element (91) in a deceleration stroke direction (89), said carrier element (91) being movable along a guide section (74) and having a spring holding area (96) and a spring deflection area (176) in the form of a curved surface area which is spaced from the spring holding area (96) and forms a side support for the spring so as to provide for a torque force effective on the carrier element (91) at least in an end position (82) of the carrier element (91), where the carrier element (91) is abutted by the spring energy store (121) for biasing the carrier element (91) into engagement with a holding section (75) provided by a guide groove (77) formed in the guide section (74).

2. The acceleration and deceleration arrangement according to claim 1, wherein the spring energy store (121) abuts in the park position (81) the spring deflection area (176).

3. The acceleration and deceleration arrangement according to claim 1, wherein the spring deflection area (176) is a single axis curved surface area whose imaginary curved surface center line extends normal to the deceleration stroke direction (89).

4. The acceleration and deceleration arrangement according to claim 1, wherein the carrier element (91) comprises a first slide element (92) oriented in a direction opposite the retardation stroke direction (89) and a second slide element (97) oriented in the retardation stroke direction (89), and the two slide elements (92, 97) interconnect a guide- and accommodation area (93) with a drag range (101).

5. The acceleration and deceleration arrangement according to claim 4, wherein, in the secured parking position (81), the spring energy store (121) has an effective force direction (122) which extends, with respect to a connecting plane of momentary pole lines (99, 178) of the slide elements (92, 97), at an angle which is larger than 35 degrees and the apex of the angle is closer to the first slide element (92) than to the second slide element (97).

6. A door fitting (20) with an acceleration and deceleration arrangement (71) according to claim 1, wherein the door fitting (20) also includes a support roller (41).

7. The door fitting according to claim 6, including a first cleaning brush (48) and a second cleaning brush (131) which are arranged in the acceleration and deceleration arrangement (71).

8. The door fitting according to claim 6, including a housing (31) with an adjustable lift member (61) for height adjustment.

9. A sliding door (1) with a door fitting (20) according to claim 6.

* * * * *